US010934957B2

(12) United States Patent
Li

(10) Patent No.: US 10,934,957 B2
(45) Date of Patent: Mar. 2, 2021

(54) METHOD AND SYSTEM FOR DETERMINING AN AMOUNT OF A SUBSTANCE IN EXHAUST GAS OF AN INTERNAL COMBUSTION ENGINE

(71) Applicant: Perkins Engines Company Limited, Peterborough (GB)

(72) Inventor: Jian Li, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 0 days.

(21) Appl. No.: 16/721,174

(22) Filed: Dec. 19, 2019

(65) Prior Publication Data

US 2020/0224599 A1 Jul. 16, 2020

(30) Foreign Application Priority Data

Jan. 11, 2019 (GB) ..... 1900375

(51) Int. Cl.
*F02D 41/14* (2006.01)

(52) U.S. Cl.
CPC ..... *F02D 41/146* (2013.01); *F02D 41/1454* (2013.01); *F02D 2200/023* (2013.01); *F02D 2200/024* (2013.01); *F02D 2200/0414* (2013.01); *F02D 2200/0614* (2013.01); *F02D 2200/101* (2013.01); *F02D 2200/1002* (2013.01)

(58) Field of Classification Search
USPC ..... 123/568.19, 568.21; 701/103–105, 108; 73/114.31, 32, 33
See application file for complete search history.

(56) References Cited

U.S. PATENT DOCUMENTS 5,918,582 A * 7/1999 Itoyama ..... F02D 41/0007 123/568.29
6,286,366 B1 * 9/2001 Chen ..... F02D 41/32 73/114.31
6,378,515 B1 * 4/2002 Geyer ..... F02D 21/08 123/683

(Continued)

FOREIGN PATENT DOCUMENTS

JP 2008-286019 A 11/2008
WO WO 2013/073450 A1 5/2013

OTHER PUBLICATIONS

United Kingdom Search Report for related Application No. GB 1900375.5; report dated Jul. 11, 2019.

*Primary Examiner* — Hai H Huynh

(57) ABSTRACT

The present invention refers to a method for determining an amount of a substance in exhaust gas of an internal combustion engine, the method comprises the steps of: determining, for an effective condition of the engine, at least one operating parameter; determining, for a reference condition of the engine, a reference amount of the substance present in exhaust gas of the engine in the reference condition when being operated based on the determined operating parameter; determining an intake manifold temperature difference between the effective condition and the reference condition of the engine; and determining an effective amount of the substance in the exhaust gas of the engine in the effective condition in dependence on the determined reference amount of the substance and the determined intake manifold temperature difference.

15 Claims, 9 Drawing Sheets

(56) References Cited

U.S. PATENT DOCUMENTS

| | | | | |
|---|---|---|---|---|
| 6,446,498 | B1 * | 9/2002 | Schricker | F02M 26/28 73/114.37 |
| 7,779,680 | B2 | 8/2010 | Sasaki et al. | |
| 8,161,944 | B2 | 4/2012 | Moriya et al. | |
| 8,621,843 | B2 | 1/2014 | Wolf et al. | |
| 8,942,912 | B2 | 1/2015 | Wang et al. | |
| 9,921,131 | B2 | 3/2018 | Singh | |
| 2003/0159521 | A1 | 8/2003 | Sarholz et al. | |
| 2004/0084015 | A1 * | 5/2004 | Sun | F02D 41/0002 123/399 |
| 2008/0148827 | A1 * | 6/2008 | Keski-Hynnila | G01M 15/05 73/114.31 |
| 2013/0085733 | A1 | 4/2013 | Vartia et al. | |
| 2015/0330319 | A1 * | 11/2015 | Nelson | F02D 41/0055 123/319 |
| 2016/0115883 | A1 | 4/2016 | Henry et al. | |
| 2016/0160785 | A1 | 6/2016 | Basu | |

* cited by examiner

METHOD AND SYSTEM FOR DETERMINING AN AMOUNT OF A SUBSTANCE IN EXHAUST GAS OF AN INTERNAL COMBUSTION ENGINE

CROSS-REFERENCE TO RELATED APPLICATION

This application claims priority under 35 USC § 119 and the Paris Convention to United Kingdom Application No. 1900375.5 filed on Jan. 11, 2019.

TECHNICAL FIELD

The present invention refers to a method for determining an amount of a substance in exhaust gas of an internal combustion engine. Further, the present invention refers to a system for determining an amount of a substance in exhaust gas of the internal combustion engine and an internal combustion engine comprising such a system.

TECHNOLOGICAL BACKGROUND

During engine development and engine calibration procedures, test runs are usually performed on an engine, i.e. on test beds, to determine and map engine performance and operating parameters. Based on such tests, it is known to build engine models which are suitable to determine or predict engine performance and emissions present in exhaust gas produced by the engine during operation.

From U.S. Pat. No. 7,779,680 B2 and U.S. Pat. No. 9,921,131 B2, for example, the use of engine models is known for determining or predicting an amount of mono-nitrogen oxides ($NO_x$) or particulate matter, such as smoke or soot, present in exhaust gas of an engine. In the known applications, the values determined or predicted by the engine models may be used to optimize engine calibration or performance of the engine during operation. Specifically, such engine models may be used for optimizing operation of exhaust gas treatment systems, such as $NO_x$ reduction catalysts or diesel particulate filters of the engine.

For example, U.S. Pat. No. 9,921,131 B2 discloses the use of such engine models for optimizing operation of a selective catalytic reduction (SCR) system. SCR systems are commonly used to remove $NO_x$ from the exhaust gas produced by internal combustion engines, such as diesel engines. In such systems, a reductant, e.g. gaseous or aqueous ammonia, is introduced into the exhaust gas of the engine by controlled injection prior to being guided through a SCR catalyst which causes a reaction between the $NO_x$ and the reductant in the exhaust gas, thereby converting $NO_x$ into nitrogen and water. Such systems, however, require precise control of the amount of the reductant to be injected into the exhaust gas. Thus, for ensuring proper operation of such SCR systems, known engine models are applied to estimate an amount of $NO_x$ in the exhaust gas which is used as an input for the SCR system to determine the amount of the reductant to be injected into the exhaust gas.

The known engine mapping and engine models are usually provided for a predefined operating condition of the engine, i.e. engine being operated in a fully warmed condition, and for a fixed engine hardware configuration. An engine under consideration, however, may be operated at other operating conditions, such as in a warmup operating condition, or with a modified engine hardware configuration which affect the engine out emissions. In this case, the emissions prediction by the engine mapping or engine model may not be accurate, thereby affecting proper treatment of engine's exhaust gas. Accordingly, for operating conditions of the engine which do not correspond to the predefined operating conditions associated to the engine mapping or engine model, new engine mapping or other engine models are required. However, the provision of new engine mapping or new engine models may be costly and time-consuming as, in practice, an engine mapping may usually take 5 to 8 weeks engine testing on test beds.

SUMMARY OF THE INVENTION

Starting from the prior art, it is an objective to provide an improved method and a system for determining an amount of a substance in exhaust gas of an internal combustion engine. Additionally, the provided method and system may efficiently be applied among different conditions of an engine to be considered.

This objective is solved by means of a method, a system and an internal combustion engine according to the independent claims. Preferred embodiments are set forth in the present specification, the Figures as well as the dependent claims.

Accordingly, a method is provided for determining an amount of a substance in exhaust gas of an internal combustion engine. The method comprises the steps of: determining, for an effective condition of the engine, at least one operating parameter; determining, for a reference condition of the engine, a reference amount of the substance present in exhaust gas of the engine in the reference condition when being operated based on the determined operating parameter; determining an intake manifold temperature difference between the effective condition and the reference condition of the engine; and determining the amount of the substance in the exhaust gas of the engine in the effective condition in dependence on the determined reference amount and the determined intake manifold temperature difference.

Further, a system for use in an internal combustion engine is provided for determining an amount of a substance in exhaust gas of the engine. The system comprises a control unit configured to determine at least one operating parameter of the engine in an effective condition; to determine, for a reference condition of the engine, a reference amount of the substance present in exhaust gas of the engine in the reference condition when being operated based on the determined operating parameter; to determine an intake manifold temperature difference between the effective condition and the reference condition of the engine; and to determine the amount of the substance in the exhaust gas of the engine in the effective condition in dependence on the determined reference amount and the determined intake manifold temperature difference.

To that end, an internal combustion engine is provided which is equipped with the above described system.

BRIEF DESCRIPTION OF THE DRAWINGS

The present disclosure will be more readily appreciated by reference to the following detailed description when being considered in connection with the accompanying drawings in which.

DETAILED DESCRIPTION OF PREFERRED EMBODIMENTS

Figure 1:
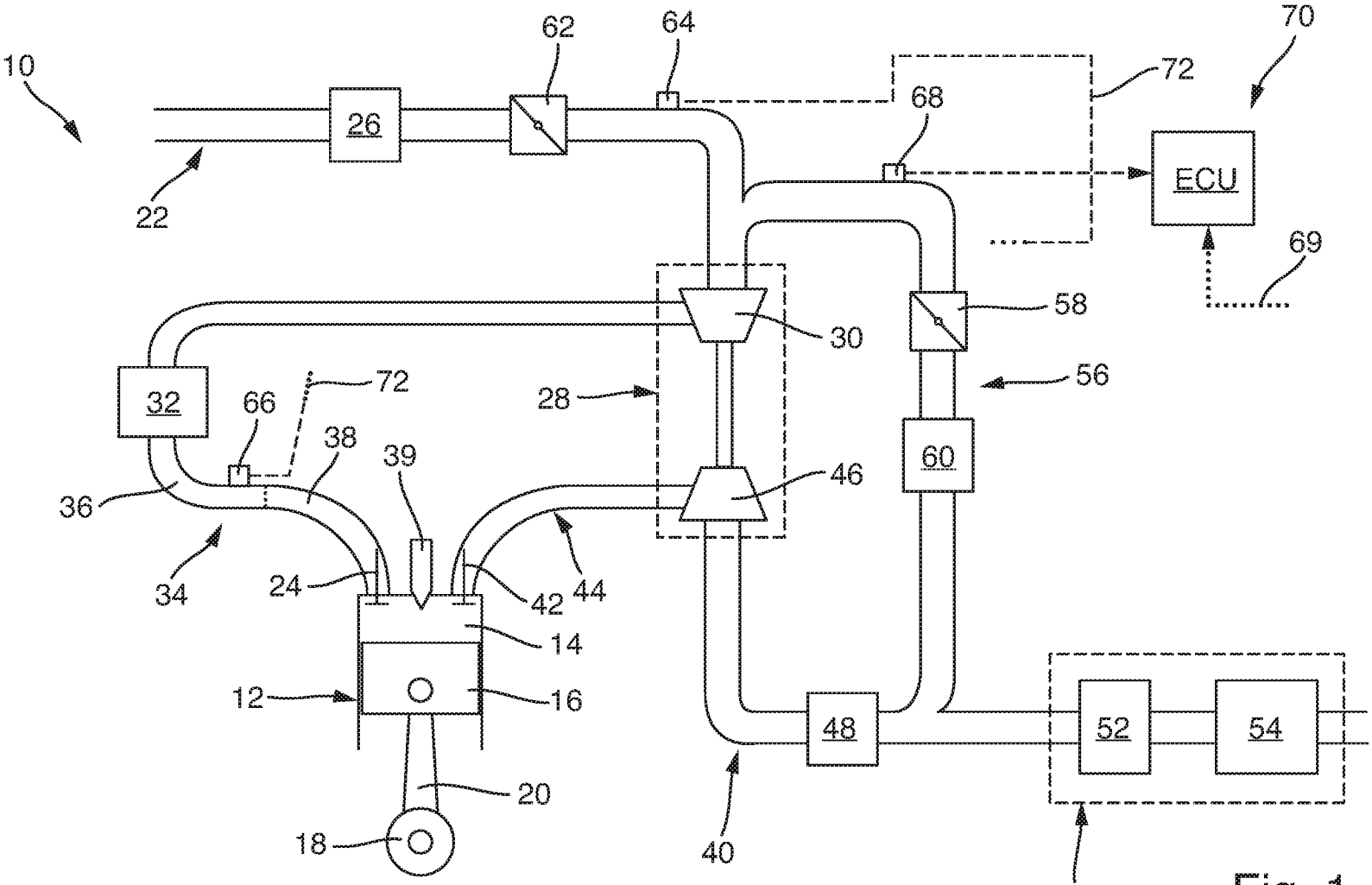
FIG. 1 schematically shows an internal combustion engine according to a first configuration which is equipped with a system for determining an amount of mono-nitrogen oxides and smoke in exhaust gas produced by the engine.

In the following, the invention will be explained in more detail with reference to the accompanying figures. In the Figures, like elements are denoted by identical reference numerals and repeated description thereof may be omitted in order to avoid redundancies.

FIG. 1 shows an internal combustion engine 10, also referred to as engine in the following, provided in the form of a diesel engine which is installed on a vehicle (not shown). Specifically, the engine 10 comprises at least one cylinder 12, i.e. a plurality of cylinders, such as four, six or eight cylinders. Each cylinder 12 is provided with a combustion chamber 14 delimited by a piston 16 which is accommodated in the cylinder 12. The piston 16 is configured for reciprocating and axial movement within the cylinder 12 and is connected to a crankshaft 18 of the engine 10 via a connecting rod 20.

During operation of the engine 10, each one of the combustion chambers 14 is supplied with a fuel mixture which is to be ignited therein so as to produce high-temperature and high-pressure gases which apply forces to and thus axially move the associated pistons 16, thereby rotating the crankshaft 18. In this way, chemical energy is transformed into mechanical energy. The fuel mixture to be supplied to and ignited in the combustion chamber 14 is formed by mixing a fuel medium, i.e. diesel fuel, with intake air, i.e. comprising fresh air from outside the vehicle, within the combustion chamber 14.

Specifically, for supplying intake air into the combustion chamber 14, the engine 10 comprises an intake air line 22 connected to the combustion chamber 14, wherein the supply of intake air into the combustion chamber 14 is variedly adjusted by means of an intake air valve 24. The intake air line 22 is configured for collecting and guiding fresh intake air from outside the vehicle to each one of the combustion chambers 14. As can be gathered from FIG. 1, fresh intake air introduced into and guided through the intake air line 22 is successively guided through an air filter 26, a turbocharger 28, i.e. a compressor 30 thereof, and a charge air cooler 32 prior to being directed to the different combustion chambers 14 via an intake manifold 34. In this configuration, the intake manifold 34 is configured to split an intake air stream flowing through a common flow passage 36 of the intake air line 22 into separate intake air streams, each of which is guided to an associated one of the combustion chambers 14 via separate flow passages 38 of the intake air line 22.

To that end, for supplying the fuel medium into the combustion chamber 14 of each cylinder 12, a fuel injection valve 39 is provided for variedly injecting the fuel medium into the combustion chamber 14.

The combustion chamber 14 of each cylinder 12 is connected to an exhaust gas line 40 for expelling combustion gases from the combustion chamber 14, i.e. after combustion of the fuel mixture took place. For controlling the expelling of combustion gases, an exhaust gas valve 42 is provided which variedly opens and closes an aperture of the exhaust gas line 40 opening into the combustion chamber 14. Exhaust gases are separately expelled from the combustion chambers 14 and are merged to a common exhaust gas stream flowing through the exhaust gas line 40 by means of an outlet manifold 44 arranged downstream of the combustion chamber 14. In the context of the present disclosure, the terms "downstream" and "upstream" refer to a flow direction of gases flowing through the intake air line 22 and the exhaust gas line 40.

Further, after being guided through the outlet manifold 44, the exhaust gas successively flows through the turbocharger 28, i.e. a turbine 46 thereof, a diesel particulate filter 48 and a selective catalytic reduction (SCR) system 50.

In the shown configuration, the turbocharger 28 is configured to charge intake air flowing through its compressor 30 upon being guided through the intake air line 22. The compressor 30 is actuated by means of the turbine 46 of the turbocharger 28 which is driven by exhaust gas expending therein upon flowing through the exhaust gas line 40.

The diesel particulate filter 48 is provided for purifying the exhaust gas discharged from the combustion chamber 14. In other words, the diesel particulate filter 48 is configured to remove particulate matter, such as soot or smoke, from the exhaust gas. Further, the diesel particulate filter 48 is designed to burn off particulate matter removed from the exhaust gas and accumulated therein. The process of burning off accumulated particulates is known as filter regeneration. This may be achieved by the use of a catalyst or by an active means, such as a fuel burner, which heats the diesel particulate filter 48 to temperatures enabling soot combustion.

The SCR system 50 is configured for removing mono-nitrogen oxides ($NO_x$) from the exhaust gas and comprises a reductant injector 52 and a catalyst 54 arranged downstream of the reductant injector 52. The reductant injector 52 is configured to introduce a reductant, e.g. gaseous or aqueous ammonia or aqueous urea, into the exhaust gas flowing through the exhaust gas line 40 by controlled injection prior to being guided through the catalyst 52 which is configured to cause a reaction between the $NO_x$ and the reductant in the exhaust gas, thereby converting $NO_x$ into nitrogen and water and thus removing $NO_x$ from the exhaust gas.

Further, the engine 10 is provided with an exhaust gas recirculation (EGR) loop 56 which branches off from the exhaust gas line 40 downstream of the diesel particulate filter 48 and upstream of the SCR system 50 for recirculating the exhaust gas, at least partly, into the intake air line 22 upstream of the turbocharger compressor 30. In the shown configuration, the amount of recirculating exhaust gas flowing into the intake air line 22 may be adjusted by means of an EGR valve 58. Further, the EGR loop 56 is provided with an EGR cooler 60 for cooling exhaust gas flowing through the EGR loop 56.

Generally, in internal combustion engines, EGR loops are used for reducing temperatures in the combustion chamber which cause the generation of an increased amount of mono-nitrogen oxides present in the exhaust gas of the engine. This is achieved by recirculating a portion of the engine's exhaust gas into the combustion chamber 14 which, in this way, constitutes a part of the fuel mixture to be ignited. As a result, the amount of gases inert to combustion is increased in the combustion chamber 14 which act as absorbents of combustion heat, thereby reducing peak temperatures in the combustion chamber and thus the generation of mono-nitrogen oxides.

In a further development, the engine 10 may be provided with a further EGR loop for recirculating exhaust gas expelled from the combustion chamber 14 prior to being guided through the turbine 46 of the turbocharger 28. Accordingly, the further EGR loop may be provided such that it branches off from the exhaust gas line 40 upstream of the turbine 46 of the turbocharger 28 and downstream of the outlet manifold 44 for recirculating the exhaust gas, at least partly, into the intake air line 22 downstream of the charge air cooler 32 and upstream of the intake manifold 34, wherein the amount of recirculating exhaust gas flowing into the intake air line 22 via the further EGR loop may be adjusted by means of a further EGR valve. In this configuration, the EGR loop 56 may refer to a low-pressure EGR loop and the further EGR loop to a high-pressure EGR loop.

In the intake air line 22, a throttle valve 62 is provided upstream of the turbocharger 28 and upstream of a junction line of the EGR loop 56 for adjusting the amount of fresh intake air to be supplied to the combustion chamber 14. Further, an intake air sensor 64 is provided downstream of the throttle valve 62 and upstream of the junction line of the EGR loop 56. The intake air sensor 64 is configured to measure a mass flow of fresh intake air flowing through the intake air line 22.

To that end, an intake manifold temperature sensor 66 is provided in the intake air line 22 arranged between the charge air cooler 32 and the intake manifold 34. The intake manifold temperature sensor 66 is configured to measure an intake manifold temperature of intake air flowing through the intake manifold 34 to be supplied into the combustion chamber 14.

In the EGR loop 56, a EGR sensor 68 is arranged downstream of the EGR valve 56 which is configured to measure a mass flow of exhaust gas recirculated into the intake air line 22.

For controlling the operation of the engine 10, an electronic control unit is provided, also referred to as ECU in the following. Specifically, the ECU controls the operation of the engine 10 based on a control signal 69 being indicative of a demanded engine power or demanded load at which the engine 10 is to be operated. For example, the control signal may be indicative of a demanded torque or demanded rotational speed of the engine 10 or a demanded air fuel ratio of the fuel mixture to be ignited in the engine 10. Based on the control signal, the ECU controls the actuation of the intake air valve 24, the fuel injection valve 39, the exhaust gas valve 42, the EGR valve 58 and the throttle valve 62 so as to set an amount and composition of the fuel mixture to be supplied into and ignited in the combustion chamber 14.

The basic structure and operation of the internal combustion engine 10 controlled by the ECU is well known to a person skilled in the art and is thus not further specified. Rather, characteristics of the engine 10 and its ECU interlinked with the present invention are addressed in the following.

The engine 10 further comprises a system 70 for determining an amount of mono-nitrogen oxides and an amount of smoke or soot present in the exhaust gas expelled from the combustion chamber 14 of the at least one cylinder 12. The system 70 comprises or is constituted by the ECU. The ECU may be configured to use the determined values of the amount of mono-nitrogen oxides and smoke in the exhaust gas for calibration purposes and/or to control operation of the diesel particulate filter 48 and/or the SCR system 50 during operation of the engine 10. Specifically, the ECU may be configured to use the determined values to control a filter regeneration process of the diesel particulate filter 48. Alternatively or additionally, the ECU may be configured to use the determined values to control the amount of reductant to be supplied into the exhaust gas for enabling proper selective catalytic reduction by means of the catalyst 54.

Figure 2:
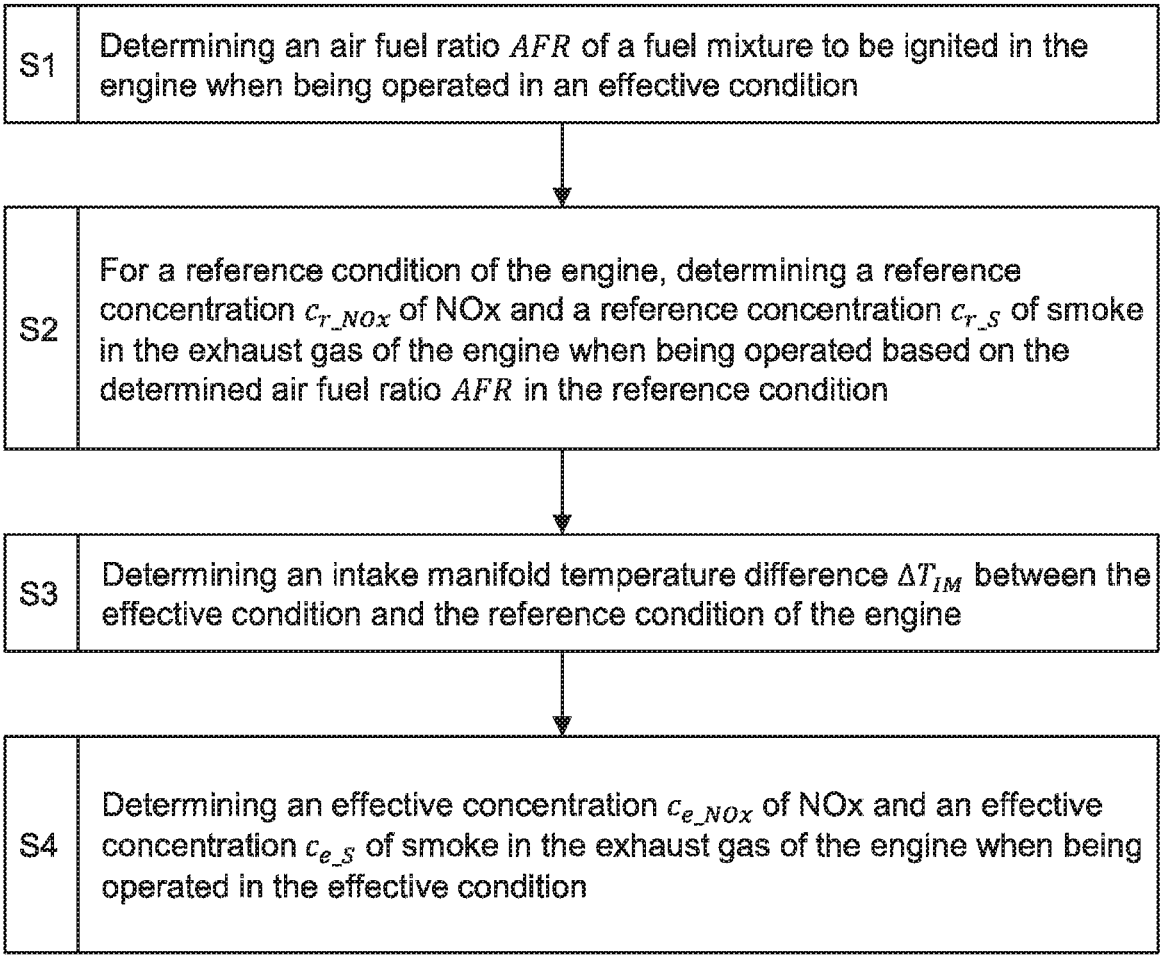
FIG. 2 shows a flow diagram schematically illustrating a method performed by the system of the internal combustion engine depicted in FIG. 1 for determining the amount of mono-nitrogen oxides and smoke in the exhaust gas produced by the engine.

In the following, a method performed by the ECU for determining an amount of mono-nitrogen oxides and an amount of smoke present in the exhaust gas of the engine 10 is specified under reference to FIG. 2 which depicts a flow diagram of the method.

In a first step S1, the ECU determines, for an effective condition of the engine 10, i.e. when being operated in the effective condition, at least one operating parameter thereof.

In the context of the present disclosure, the term "effective condition" refers to an operating condition of the engine 10 which may be an "actual operating condition" of the engine 10, i.e. an operating condition in which the engine 10 is operated in, or a "desired or demanded operating condition" of the engine, 10, i.e. an operating condition in which the engine is to be operated. In other words, the effective condition refers to an operating condition under consideration, i.e. for which the amount of $NO_x$ is to be determined.

Specifically, the at least one determined operating parameter comprises an air fuel ratio AFR of the fuel mixture to be supplied to the combustion chamber 14 in the effective condition of the engine 10. In the context of the present disclosure, the air fuel ratio AFR refers to a mass ratio of intake air relative to fuel medium:

$$AFR = \frac{m_{air}}{m_{fuel}}, \tag{1}$$

wherein $m_{air}$ indicates a mass of intake air in the fuel mixture and $m_{fuel}$ indicates a mass of fuel medium in the fuel mixture.

For determining the air fuel ratio AFR for the effective condition, the ECU is connected to the intake air sensor 62 and the EGR sensor 58 via a signal line 72 to receive values of the mass flow of fresh intake air measured by the intake air sensor 64 and of the mass flow of exhaust gas recirculated into the intake air line 22 measured by the EGR sensor 68. Based on the measured data, the ECU is configured to determine the air fuel ratio AFR of an actual operating condition of the engine 10. Alternatively or additionally, the ECU may be configured to receive a value for the air fuel ratio AFR or to determine the air fuel ratio AFR based on the received control signal 69 which, accordingly, may be indicative of the air fuel ratio AFR for the effective condition of the engine 10.

In a second step S2 of the method, the ECU calculates or determines, for a reference condition of the engine 10, a reference amount $c_{r_NOx}$ of $NO_x$ and a reference amount $c_{r_s}$ of smoke to be present in the exhaust gas of the engine 10 when being operated in the reference condition based on the determined operating parameter, i.e. the determined air fuel ratio AFR.

In the context of the present disclosure, the term "reference condition" refers to an operating condition of the engine 10, for which an engine mapping and/or an engine model is provided. Specifically, in the shown configuration, the effective condition and the reference condition refer to different operating conditions of the same hardware configuration of the engine 10, i.e. as depicted in FIG. 1. Alternatively or additionally, the effective condition and the reference condition may refer to different hardware configurations of the engine 10.

As set forth above, for the reference condition, an engine mapping and/or an engine model are/is provided. Accordingly, the provided engine mapping and/or the provided engine model are applied to so as to determine the reference amount $c_{r_NOx}$ of $NO_x$ and the reference amount $c_{r_s}$ of smoke in exhaust gas of the engine 10 when being operated in the reference condition.

Generally, the reference amount $c_{r_NOx}$ of $NO_x$ present in the exhaust gas of the engine 10 in the reference condition may be expressed as a function $F_{cr_NOx}$ of an air fuel ratio AFR of a fuel mixture ignited in the engine 10 as follows:

$$c_{r_NOx}=F_{cr_NOx}(\mathrm{AFR}) \tag{2}$$

Accordingly, the reference amount $c_{r_S}$ of smoke present in the exhaust gas of the engine 10 in the reference condition may be expressed as a function of an air fuel ratio AFR of a fuel mixture ignited in the engine 10 as follows:

$$c_{r_S}=F_{cr_S}(\mathrm{AFR}) \tag{3}$$

For calculating the respective reference amounts $c_{r_NOx}$, $c_{r_S}$, the ECU has access to or comprise the function $F_{cr_NOx}$ for calculating the reference amount $c_{r_NOx}$ of $NO_x$ present in the exhaust gas of the engine 10 in the reference condition and the function $F_{cr_S}$ for calculating the reference amount $c_{r_S}$ of smoke present in the exhaust gas of the engine 10 in the reference condition. In general, each of the functions $F_{cr_NOx}$, $F_{cr_S}$ indicates a mapping or relation that associates an air fuel ratio AFR value, i.e. constituting an input of the functions, to a value of the respective reference amount $c_{r_NOx}$, $c_{r_S}$ of $NO_x$ or smoke, i.e. constituting an output of the functions. These functions $F_{cr_NOx}$, $F_{cr_S}$ may constitute an engine model, i.e. a mathematical model, which may be derived based on reference performance data of the engine 10 for the reference condition. Specifically, the engine model and/or the reference performance data may be provided based on an engine mapping procedure. The engine mapping procedure may be performed for the reference condition of the engine 10.

For calculating the respective reference amounts $c_{r_NOx}$, $c_{r_S}$ of $NO_x$ or smoke, the functions $F_{cr_NOx}$, $F_{cr_S}$ may further depend on other operating parameters, i.e. forming further input parameter of the function. The other operating parameters may comprise at least one of an engine speed, an engine torque, a cylinder pressure, a temperature value indicative of a combustion temperature in the combustion chamber 14, i.e. an intake manifold temperature value $T_{IM}$, and others. These further operating parameters may be determined during the above described step S1 of the method together with the air fuel ratio AFR. In other words, in step S2, the respective reference amounts $c_{r_NOx}$, $c_{r_S}$ of $NO_x$ or smoke are determined, in particular based on the engine model and/or the reference performance data of the engine 10, as a function of at least one of: the air fuel ratio AFR, an engine speed, an engine torque, a cylinder pressure, and a temperature value indicative of a combustion temperature.

Specifically, the respective reference amounts $c_{r_NOx}$, $c_{r_S}$ of $NO_x$ or smoke refer to a concentration of the respective substance in the exhaust gas of the engine 10 in the reference condition. In other words, in step S2, a reference concentration $c_{r_NOx}$ of $NO_x$ and a reference concentration $c_{r_S}$ of smoke in the exhaust gas of the engine 10 in the reference condition are determined.

In a third step S3 of the method, the ECU determines an intake manifold temperature difference $\Delta T_{IM}$ between the effective condition and the reference condition of the engine 10:

$$\Delta T_{IM}=T_{e_IM}-T_{r_IM}, \tag{4}$$

wherein $T_{e_IM}$ indicates an effective intake manifold temperature in the effective condition of the engine 10, and $T_{r_IM}$ indicates a reference intake manifold temperature in the reference condition of the engine 10. In general, the intake manifold temperature refers to a temperature of the intake air when flowing through the intake manifold 34. Further, the intake manifold temperature is indicative of a combustion temperature pertaining in the combustion chamber 14 of the at least one cylinder 12 during operation of the engine 10.

For determining the intake manifold temperature difference $\Delta T_{IM}$, at first, the ECU determines the effective intake manifold temperature $T_{e_IM}$ and the reference intake manifold temperature $T_{r_IM}$ prior to calculating the difference therebetween so as to determine the intake manifold temperature difference $\Delta T_{IM}$. Specifically, for obtaining the effective intake manifold temperature $T_{e_IM}$, the ECU is connected to the intake manifold temperature sensor 66 via the signal line 72 to receive values of the effective intake manifold temperature $T_{e_IM}$ when the engine is operated in the effective condition. To that end, for obtaining the reference intake manifold temperature $T_{r_IM}$, the ECU has access to or comprises the engine model or the reference performance data of the engine 10 so as to determine the reference intake manifold temperature $T_{r_IM}$ in the reference condition of the engine 10.

Then, according to step S4, the ECU calculates or determines an effective amount $c_{e_NOx}$ of $NO_x$ and an effective amount $c_{e_s}$ of smoke in the exhaust gas of the engine 10 when being operated in the effective condition. Specifically, the determined effective amounts $c_{e_NOx}$, $c_{e_s}$ of $NO_x$ and smoke refer to a concentration of the respective substance in the exhaust gas of the engine 10 in the effective condition. In other words, in step S4, an effective concentration $c_{e_NOx}$ of $NO_x$ and an effective concentration $c_{r_S}$ of smoke in the exhaust gas of the engine 10 in the effective condition are determined.

Specifically, in step S4, the ECU calculates the effective concentration $c_{e_NOx}$ of $NO_x$ in the exhaust gas of the engine 10 in the effective condition based on the following formula:

$$c_{e_NOx}=\frac{c_{r_Nox}}{1+k_{NOx}\times\Delta T_{IM}}, \tag{5}$$

wherein $c_{e_NOx}$ indicates the effective concentration of $NO_x$ in the exhaust gas of the engine 10 in the effective condition; $c_{r_NOx}$ indicates the reference concentration of $NO_x$ in the exhaust gas of the engine 10 in the reference condition; AFR indicates the determined air fuel ratio; $k_{NOx}$ refers to a similarity coefficient; and $\Delta T_{IM}$ refers to the determined intake manifold temperature difference.

In the above equation (5), the similarity coefficient refers to a correction factor enabling to use a common engine model, i.e. used for calculating the reference concentration $c_{r_NOx}$ of $NO_x$ as depicted in above equation (2), among different operating conditions or configurations of the engine 10 for calculating the effective concentration of $NO_x$ and smoke.

Further, among the different operating conditions, the intake manifold temperature of intake air guided into the combustion chamber 14 of the engine 10 may differ from one another. Accordingly, by means of the above equation (5), the suggested method enables to compensate for different intake manifold temperatures of the intake air to be guided into the combustion chamber 14 of the engine 10 while applying an engine model associated to the reference condition of the engine 10.

The similarity coefficient $k_{NOx}$ depends on the determined reference concentration $c_{r_NOx}$ of $NO_x$ and the determined air fuel ratio AFR, in particular on a ratio thereof. Accordingly, the similarity coefficient $k_{NOx}$ may be expressed as a function $F_{k_NOx}$ of a ratio of the reference concentration $c_{r_NOx}$ of $NO_x$ relative to the air fuel ratio AFR as follows:

$$k_{NOx} = F_{k_NOx}\left(\frac{c_{r_NOx}}{AFR}\right) \tag{6}$$

Likewise, in step S4, the ECU calculates the effective concentration $c_{e_s}$ of smoke in the exhaust gas of the engine 10 in the effective condition based on the following formula:

$$c_{e_S} = \frac{c_{r_S}}{1 + k_S \times \Delta T_{IM}}, \tag{7}$$

wherein $c_{e_s}$ indicates the effective concentration of smoke in the exhaust gas of the engine 10 in the effective condition; $c_{r_S}$ indicates the reference concentration of smoke in the exhaust gas of the engine 10 in the reference condition; AFR indicates the determined air fuel ratio; $k_S$ refers to a similarity coefficient; and $\Delta T_{IM}$ refers to the determined intake manifold temperature difference.

In the above equation (7), the similarity coefficient refers to a correction factor enabling to use a common engine model, i.e. used for calculating the reference concentration $c_{r_S}$ of smoke as depicted in above equation (3), among different operating conditions or configurations of the engine 10 for calculating respective $NO_x$ and smoke concentrations in the exhaust gas.

The similarity coefficient $k_S$ depends on the determined reference concentration $c_{r_NOx}$ of $NO_x$ and the determined air fuel ratio AFR, in particular on a ratio thereof. Accordingly, the similarity coefficient $k_S$ may be expressed as a function $F_{k_S}$ of a ratio of the reference concentration $c_{r_NOx}$ of $NO_x$ relative to the air fuel ratio AFR as follows:

$$k_S = F_{k_S}\left(\frac{c_{r_NOx}}{AFR}\right) \tag{8}$$

It has been found that different operating conditions and/or different hardware configuration of the engine 10 usually affect the intake manifold temperatures of intake air and thus the combustion temperature in the combustion chamber 14 of the engine's cylinders 12. However, by increasing the intake manifold temperature, a concentration of $NO_x$ increases in the exhaust gas, while the concentration of smoke decreases and the exhaust gas. These effects are depicted in FIGS. 3 and 4.

Figure 3:
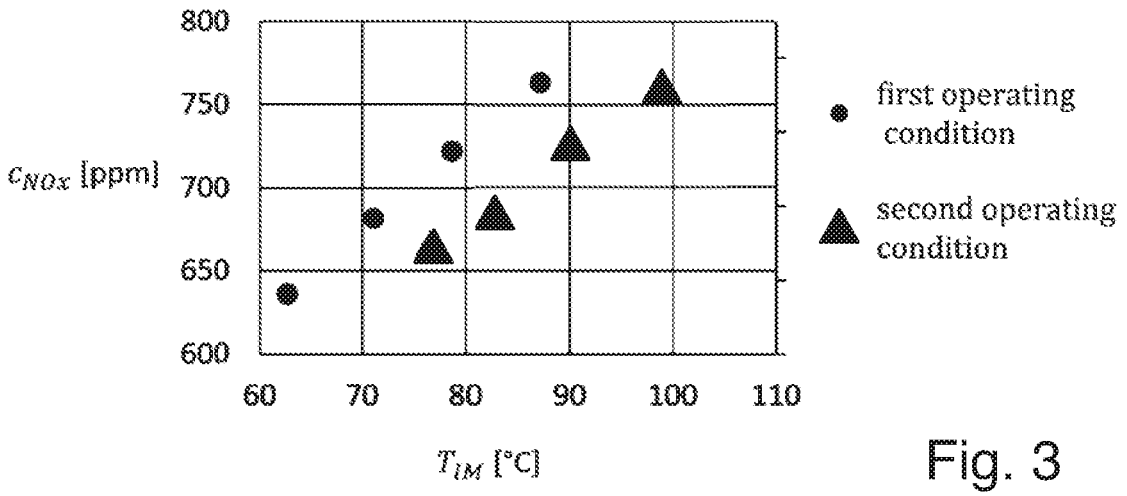
FIGS. 3 and 4 show a diagram illustrating effects of different intake manifold temperatures on the concentration of mono-nitrogen oxides and smoke in the exhaust gas.

Specifically, FIG. 3 depicts a diagram illustrating the effect of different intake manifold temperatures on the concentration of $NO_x$ in the exhaust gas of the engine 10 for two different operating conditions. The abscissa of the diagram depicts the intake manifold temperature $T_{IM}$ and the ordinate depicts the associated concentration $c_{NOx}$ of $NO_x$ in the exhaust gas of the engine 10. The diagram shows a first point set associated to a first operating condition, in which the engine 10 is operated at an engine speed of 2200 rpm and at an engine torque of 135 Nm, and a second point set associated to a second operating condition, in which the engine 10 is operated at an engine speed of 2200 rpm and at an engine torque of 478 Nm.

Figure 4:
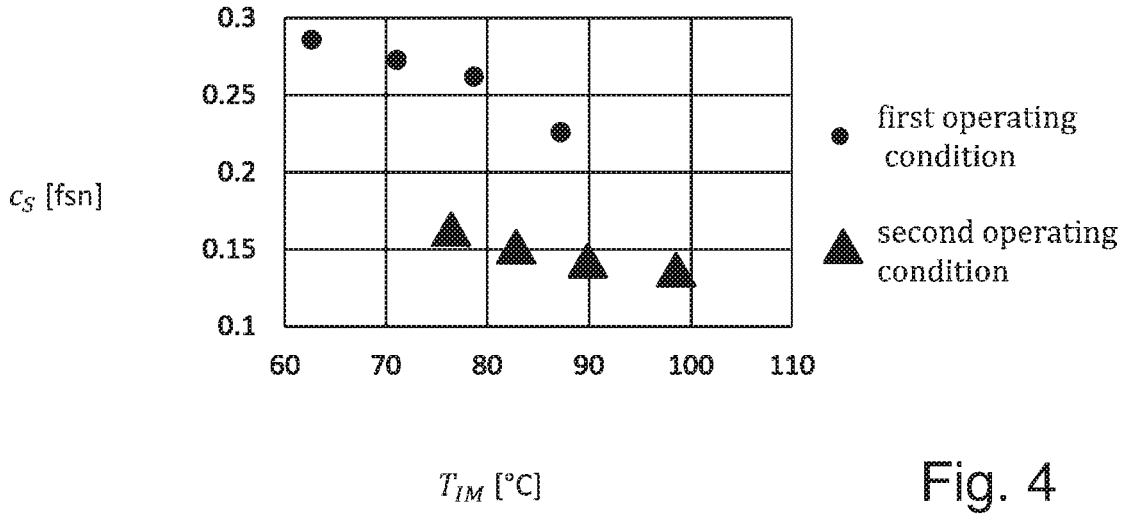

FIG. 4 depicts a diagram illustrating the effect of different intake manifold temperatures on the concentration of smoke in the exhaust gas of the engine 10 for the two different operating conditions. The abscissa of the diagram depicts the intake manifold temperature $T_{IM}$ and the ordinate depicts the associated concentration $c_S$ of smoke in the exhaust gas of the engine 10 quantified by the filter smoke number (fsn). The diagram shows a first point set associated to the first operating condition and a second point set associated to the second operating condition of the engine 10.

Accordingly, to take account of the above describe effects, in the proposed method, the effective concentrations $c_{e_NOx}$, $c_{e_S}$ of $NO_N$ and smoke are calculated in dependence on the intake manifold temperature difference $\Delta T_{IM}$ so as to compensate for different intake manifold temperatures caused by operating the engine 10 in different operating conditions and/or with different hardware configurations.

Figure 5:
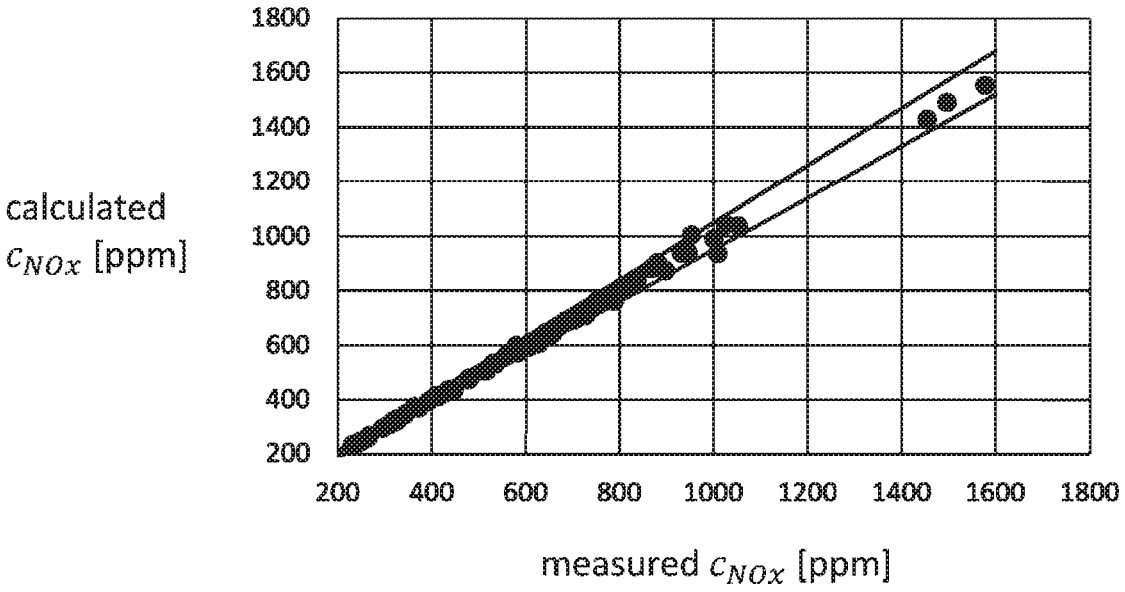
FIGS. 5 and 6 show a diagram illustrating a comparison between calculated values obtained by means of the proposed method and measured values of the concentration of mono-nitrogen oxides and smoke in the exhaust gas.
Figure 6:
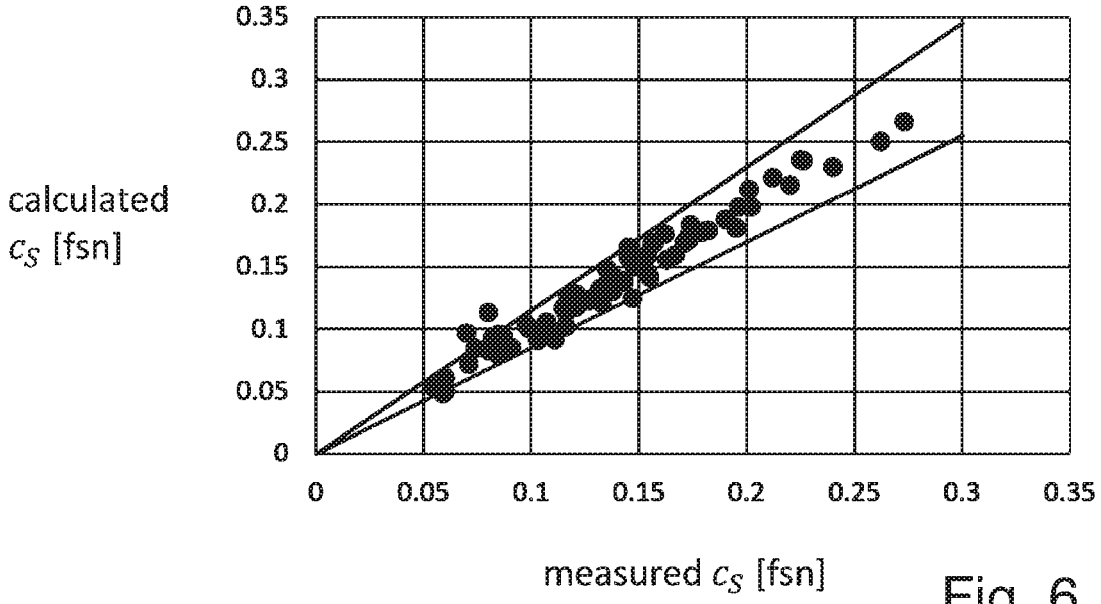

For validation purposes of the proposed method, in FIGS. 5 and 6, values calculated by the ECU are compared to measured values of the effective concentrations of $NO_N$ and smoke during operation of the engine 10.

Specifically, FIG. 5 depicts a diagram illustrating a comparison between calculated and measured values of the effective concentration of $NO_N$ for different operating conditions of the engine 10. The abscissa of the diagram depicts measured values and the ordinate depicts calculated values of the effective concentration $c_{e_NOx}$ of $NO_N$. The diagram shows a set of points which are associated to different operating conditions of the engine 10. Further, two lines are depicted which indicate a deviation of +5% and of −5% between the measured and calculated values.

FIG. 6 depicts a diagram illustrating a comparison between calculated and measured values of the effective concentration of smoke for different operating conditions of the engine 10. The abscissa of the diagram depicts measured values and the ordinate depicts calculated values of the effective concentration $c_{e_S}$ of smoke. The diagram shows a set of points which are associated to different operating conditions of the engine 10. Further, two lines are depicted which indicate a deviation of +15% and of −15% between the measured and calculated values.

Figure 7:
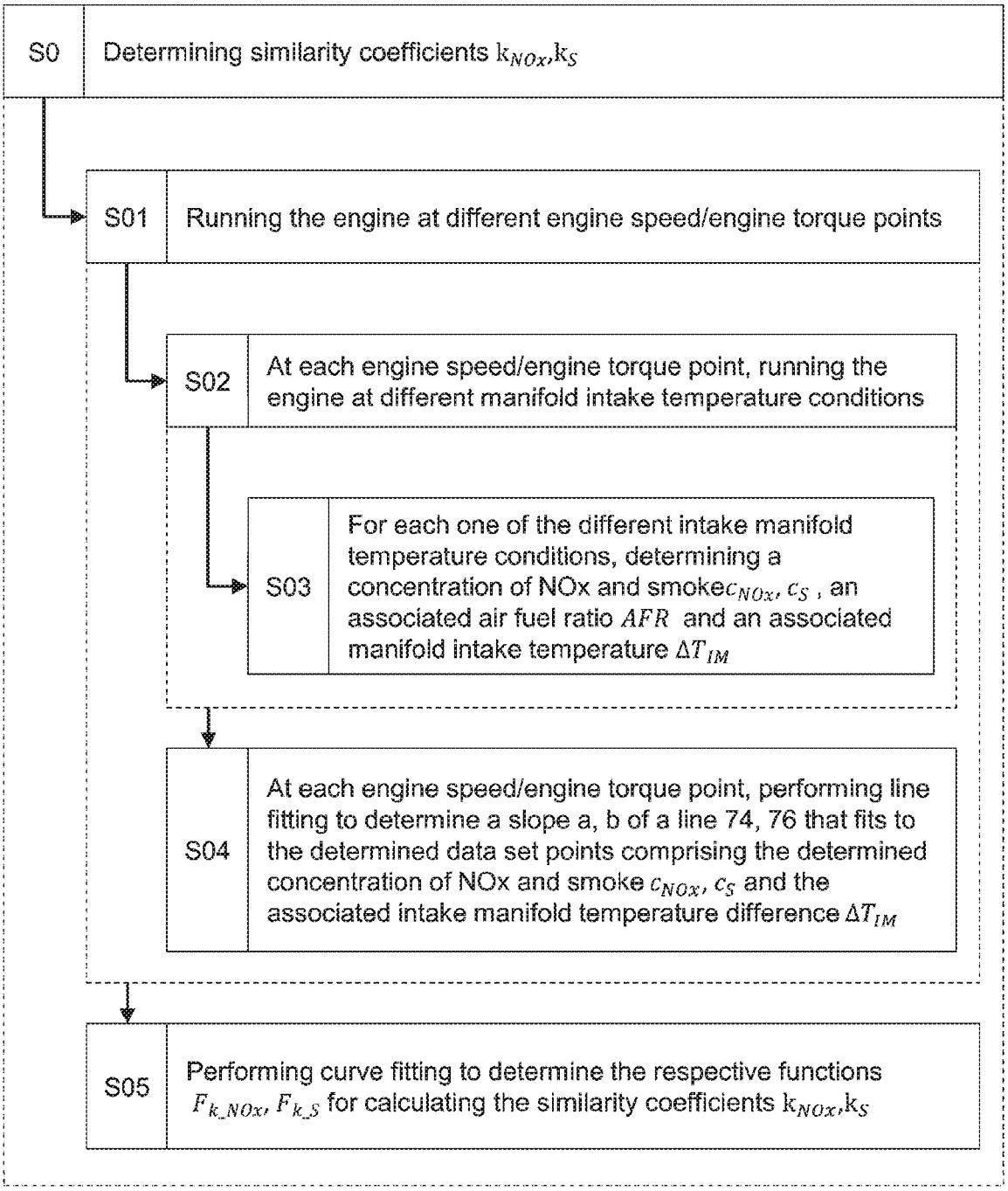
FIG. 7 shows a flow diagram schematically illustrating a method step for determining similarity coefficients applied in the proposed method.

In the following, a further step S0 of the proposed method is described under reference to FIG. 7. The step S0 is provided for determining the respective similarity coefficients $k_{NOx}$, $k_S$ in dependence on the determined reference concentration $c_{r_NOx}$ of $NO_x$ and the determined air fuel ratio AFR, in particular in dependence on a ratio thereof.

More specifically, in step S0, a respective function or mathematical model $F_{k_NOx}$, $F_{k_S}$ is provided for calculating the respective similarity coefficient $k_{NOx}$, $k_S$ as a function of the determined reference concentration $c_{r_NOx}$ and the determined air fuel ratio AFR, in particular as a function of a ratio thereof as depicted by equations (6) and (8). The step S0 may be performed before any one of the steps S1 to S3 or during step S4.

Figure 8:
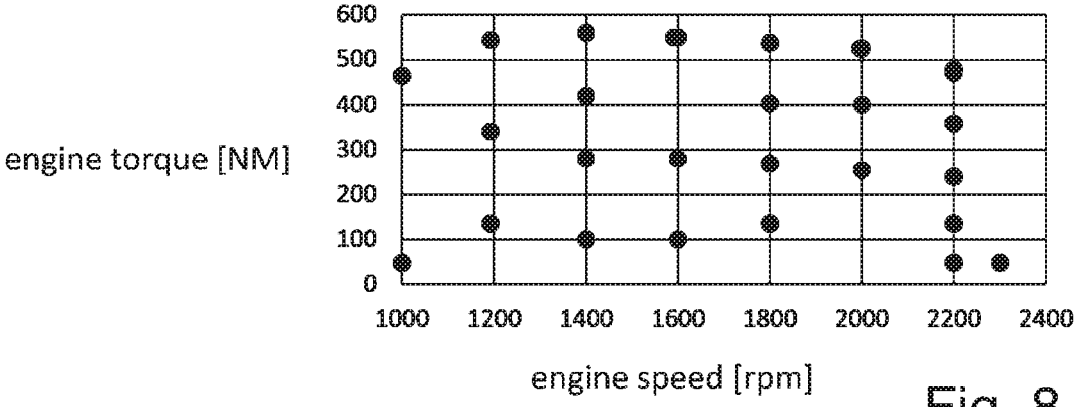
FIGS. 8 to 12 depict diagrams for illustrating the method step for determining the similarity coefficients.

In a first sub step S01, the engine is ran, i.e. on a test bed, at different engine speed and different engine torque points as depicted in FIG. 8. Specifically, FIG. 8 shows a diagram illustrating the different speed/load points, at which the engine 10 is driven. The abscissa of the diagram depicts the engine speed and the ordinate depicts the engine torque. Further, the diagram shows a set of speed/load points, at each of which the engine is driven during the step S0.

Further, in a sub step S02, at each engine speed/engine torque point, the engine is ran at different intake manifold temperature conditions. In a sub step S03, for each one of the different intake manifold temperature conditions, a concentration $c_{NOx}$, $c_S$ of NOx and smoke, an associated air fuel ratio AFR and an associated intake manifold temperature difference $\Delta T_{IM}$ is determined.

Figure 9:
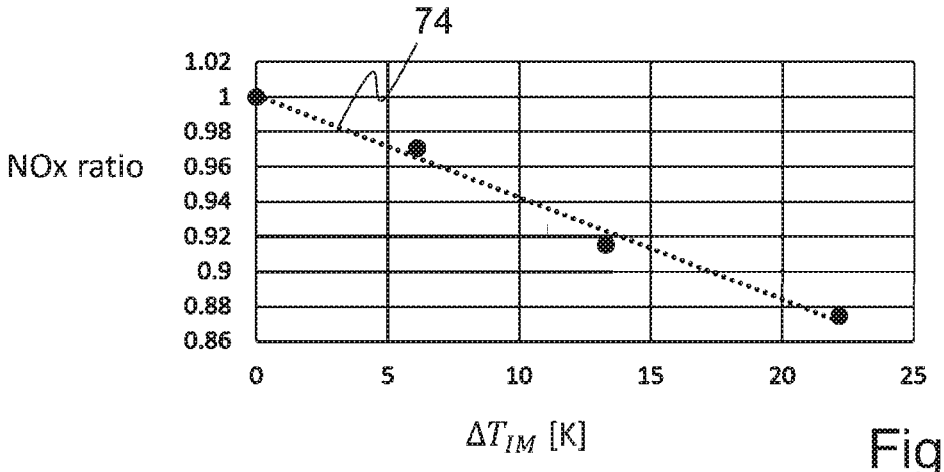
Figure 10:
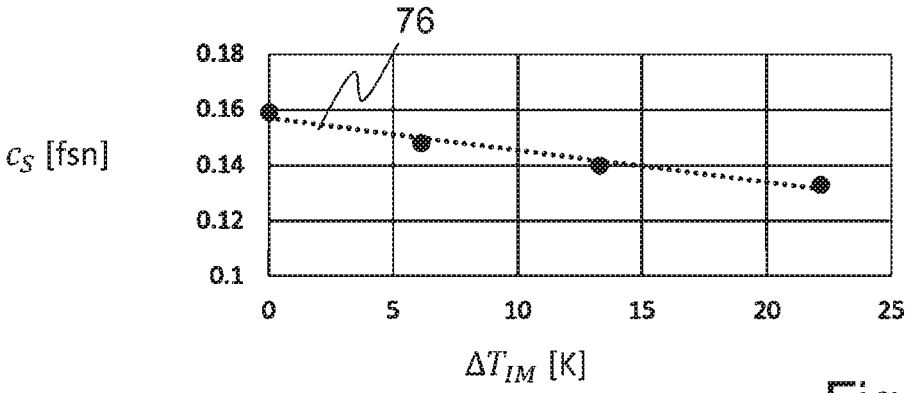

Thereafter, in a step S04, for each one of the different engine speed/engine torque points, line fitting is performed to determine a slope a of a line 74 that fits to the determined data set points comprising the determined concentration $c_{NOx}$ of $NO_x$ and the associated intake manifold temperature difference $\Delta T_{IM}$, as depicted in FIG. 9, as well as a slope b of a further line 76 that fits to the determined data set points comprising the determined concentration of smoke $c_S$ and the associated intake manifold temperature difference $\Delta T_{IM}$, as depicted in FIG. 10. In general, "line fitting" refers to a process of constructing a straight line that has the best fit to a series of data points.

Specifically, FIG. 9 shows a diagram illustrating values of the concentration $c_{NOx}$ of $NO_x$ in the exhaust gas determined at the different intake manifold temperature conditions, but for a common engine speed/engine torque point, here at engine speed of 2200 rpm and engine torque of 478 Nm. The abscissa of the diagram depicts the intake manifold temperature difference $\Delta T_{IM}$ relative to the first data point of the diagram and the ordinate depicts a $NO_x$ ratio of the determined concentration $c_{NOx}$ of $NO_x$ relative to the value of the concentration $c_{NOx}$ of $NO_x$ of the first data point depicted in the diagram. Further, the fitting line 74 is depicted that has been determined by the line fitting process performed in step S04 and that has the best fit to the data points depicted in the diagram.

FIG. 10 shows a diagram illustrating values of the concentration $c_S$ of smoke in the exhaust gas determined at the different intake manifold temperature conditions, but for a common engine speed/engine torque point, here at engine speed of 2200 rpm and engine torque of 478 Nm. The abscissa of the diagram depicts the intake manifold temperature difference $\Delta T_{IM}$ relative to the first data point of the diagram and the ordinate depicts the concentration $c_S$ of smoke in the exhaust gas. Further, the further fitting line 76 is depicted that has been determined by the line fitting process performed in step S04 and that has the best fit to the data points depicted in the diagram.

Figure 11:
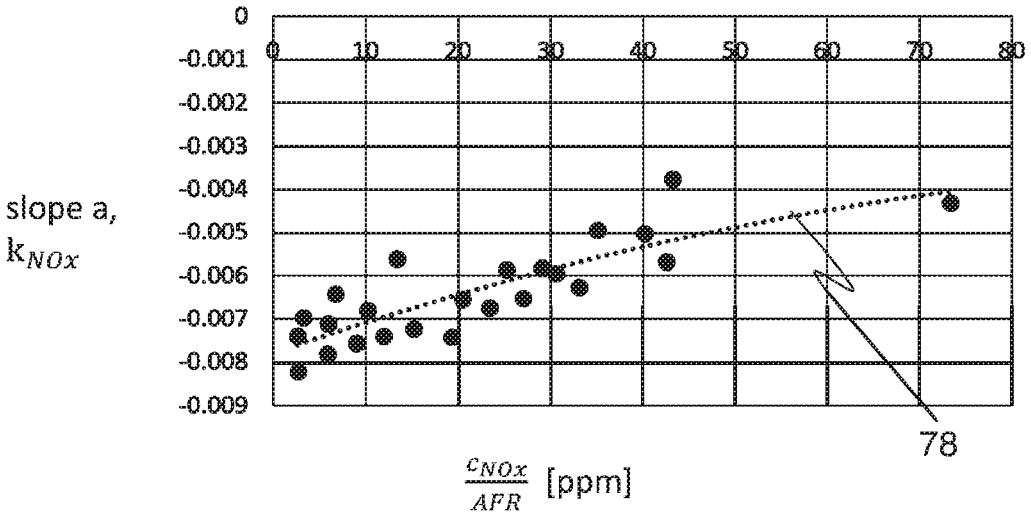
Figure 12:
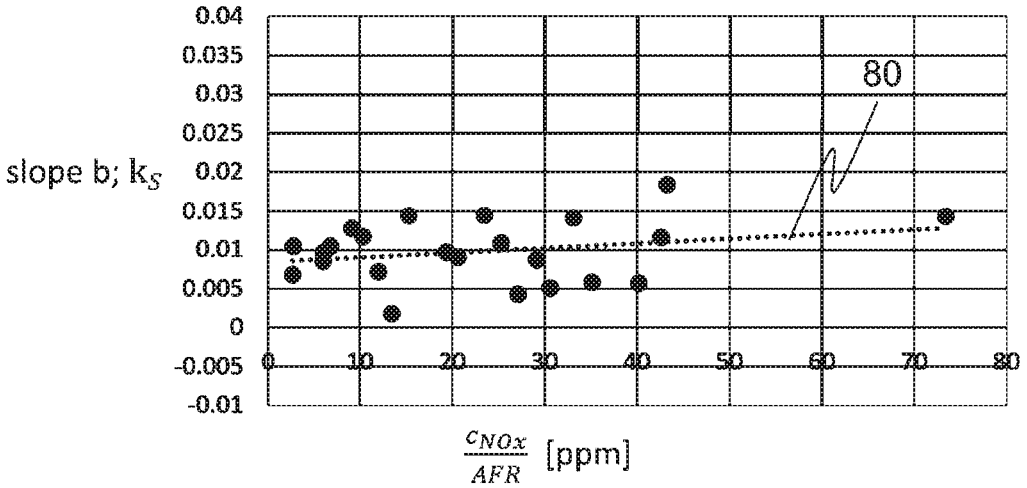

In a next step, a set of data points is determined, in which the determined slopes a, b of the lines 74 and 76 are respectively associated to a ratio of the determined respective concentration of $NO_x$ relative to the determined respective air fuel ratio AFR. In FIGS. 11 and 12, the thus determined set of data points are shown.

Specifically, FIG. 11 depicts a diagram illustrating the slope a of lines 74 for different ratios of the determined concentration $c_{NOx}$ of $NO_x$ in the exhaust gas relative to the determined respective air fuel ratio AFR. The shown data set points have been obtained for each one of the above described engine runs. The abscissa of the diagram depicts the slope a of the lines 74 obtained for different intake manifold temperature conditions at different engine speed/engine torque points and the ordinate depicts the ratio of the determined respective concentration $c_{NOx}$ of $NO_x$ relative to the determined respective air fuel ratio.

FIG. 12 depicts a diagram illustrating the slope b of lines 76 for different ratios of the determined concentration $c_{NOx}$ of $NO_x$ in the exhaust gas relative to the determined respective air fuel ratio AFR. The shown data set points have been obtained for each one of the above described engine runs. The abscissa of the diagram depicts the slope b of the lines 76 obtained for different intake manifold temperature conditions and at different engine speed/engine torque points and the ordinate depicts the ratio of the determined respective concentration $c_{NOx}$ of $NO_x$ relative to the determined respective air fuel ratio.

Then, in the sub step S05, a curve fitting procedure is performed for determining the functions $F_{k_NOx}$, $F_{k_S}$, in particular as a polynomial function. In general, "curve fitting" refers to a mathematical process of constructing a mathematical function that has the best fit to a series of data points.

Specifically, for determining the function $F_{k_NOx}$, a curve fitting process is performed for constructing a mathematical function, i.e. a $2^{nd}$ degree polynomials or polynomials with a higher degree, that has the best fit to the series of data points depicted in FIG. 11. The result of the curve fitting process is depicted in FIG. 11 in the form of a fitting curve 78 representing the constructed mathematical function and thus the function $F_{k_NOx}$. The constructed mathematical function provides a mapping or relation that associates a ratio of the concentration $c_{NOx}$ of $NO_x$ in the exhaust gas relative to the determined respective air fuel ratio AFR, i.e. constituting an input of the function, to a respective slope a, i.e. constituting an output of the function. Here, the slope a corresponds to the similarity coefficient $k_{NOx}$.

Accordingly, for determining the function $F_{k_S}$, a further curve fitting process is performed for constructing a mathematical function, i.e. a $2^{nd}$ degree polynomials or polynomials with a higher degree, that has the best fit to the series of data points depicted in FIG. 12. The result of the curve fitting process is depicted in FIG. 12 in the form of a further fitting curve 80 representing the constructed mathematical function and thus the function $F_{k_S}$. The constructed mathematical function provides a mapping or relation that associates a ratio of the concentration $c_{NOx}$ of $NO_x$ in the exhaust gas relative to the determined respective air fuel ratio AFR, i.e. constituting an input of the function, to a respective slope b, i.e. constituting an output of the function. Here, the slope b corresponds to the similarity coefficient $k_S$.

Figure 13:
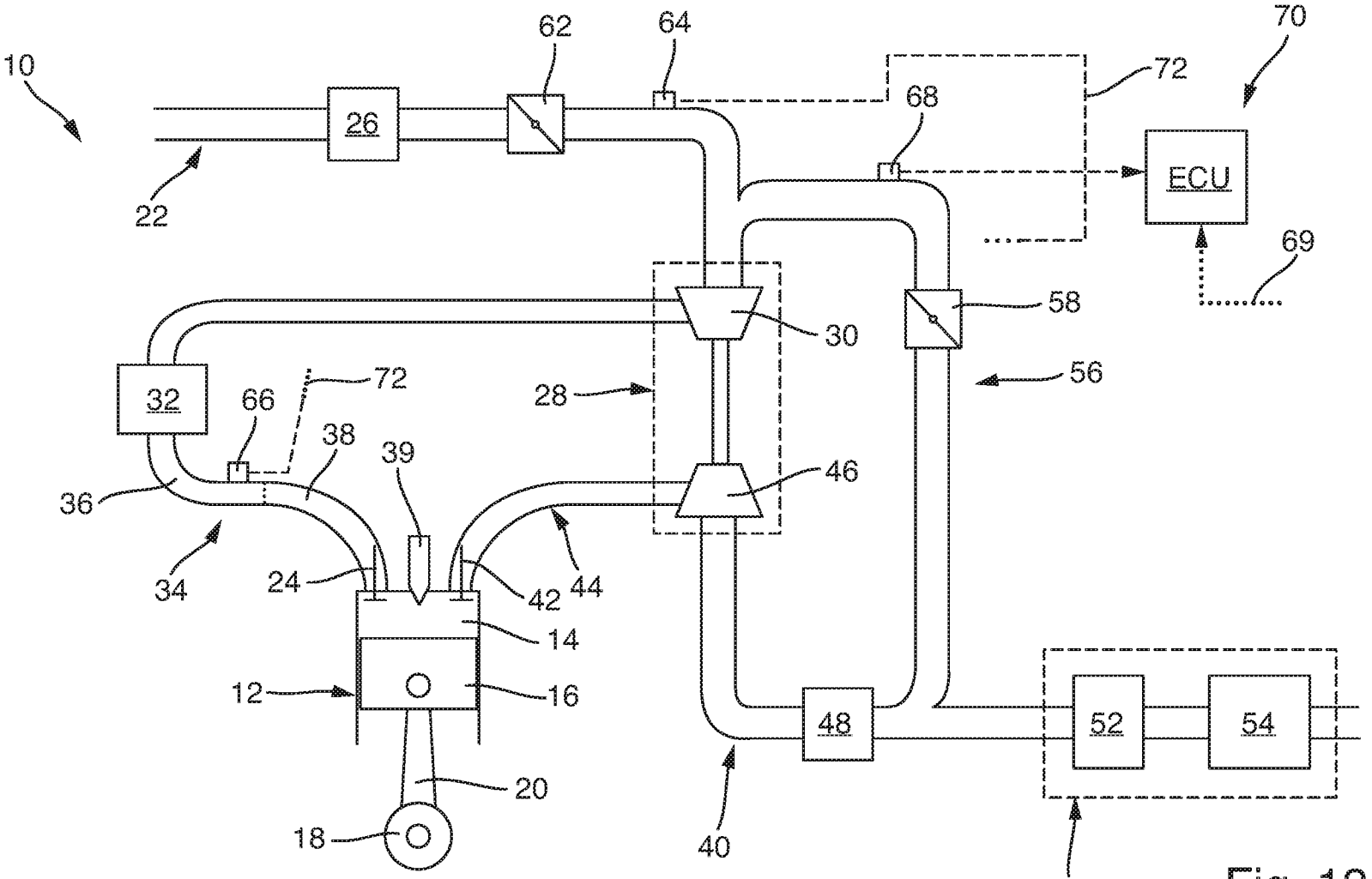
FIG. 13 schematically shows an internal combustion engine according to a second configuration.

FIG. 13 shows another configuration of the engine 10 that differs from the engine 10 depicted in FIG. 1 in that the EGR cooler 60 is omitted from the EGR loop 56. As a result, when running the engine 10 depicted in FIG. 13 and the engine 10 depicted in FIG. 1 with exactly same calibration and operating parameters, an intake manifold temperature of the intake air flowing through the intake manifold 34 of the engine 10 depicted in FIG. 13 may be 10K to 30K higher compared to the configuration depicted in FIG. 1.

However, as the above described method for determining an amount of mono-nitrogen oxides and an amount of smoke or soot present in the exhaust gas is suitable to compensate for different intake manifold temperature levels, i.e. caused by differing operation conditions or hardware configurations of the engine 10, the above described method steps S1 to S4, i.e. the above described formulas according to equations (5) and (7), may be applied by the ECU of the engine 10 depicted in FIG. 13 for calculating the concentration of $NO_x$ and smoke in the exhaust gas. Accordingly, the function $F_{cr_NOx}$ for calculating the reference concentration $c_{r_NOx}$ of $NO_x$ and the function $F_{cr_S}$ for calculating the reference concentration $c_{r_S}$ of smoke present in the exhaust gas of the engine 10 in the reference condition as well as the functions for calculating the respective similarity coefficients $F_{k_NOx}$, $F_{k_S}$, which are constructed based on the engine configuration depicted in FIG. 1, may also be applied to for calculating the concentration of $NO_x$ and smoke in the exhaust gas of the engine configuration depicted in FIG. 13. Thus, although the hardware configuration of the engine 10 is changed, the proposed method enables that engine models, i.e. the functions $F_{cr_NOx}$, $F_{cr_S}$ $F_{k_NOx}$ and $F_{k_S}$, constructed for the reference condition or reference configuration, as depicted in FIG. 1, can be used for other operating conditions or hardware configuration of the engine 10. Accordingly, by the proposed method, engine mapping procedures for constructing new engine models associated to changed operating conditions or hardware configurations of the engine 10 may be omitted.

Figure 14:
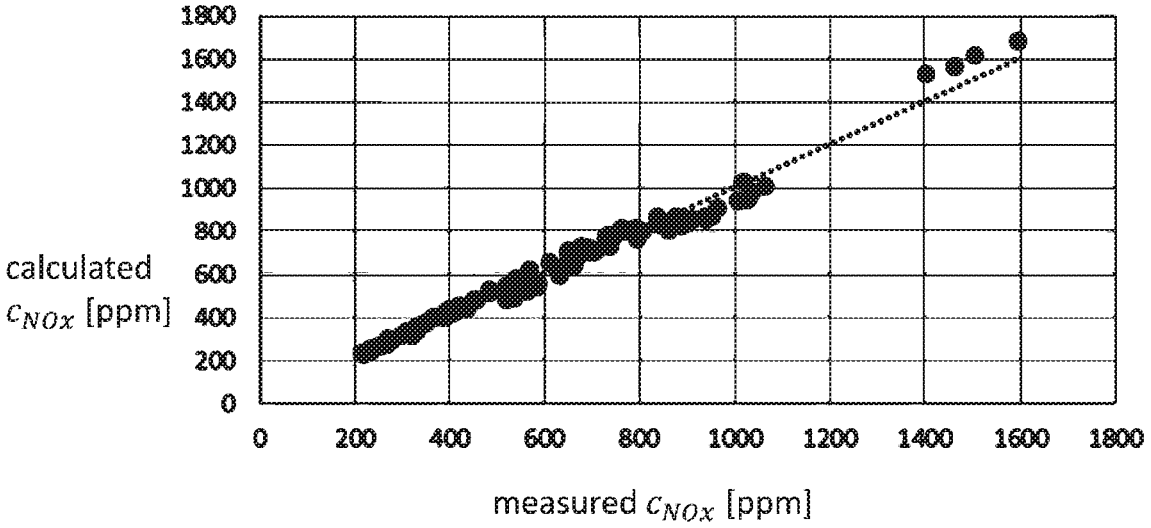
FIGS. 14 and 15 show a diagram illustrating a comparison between calculated values obtained by means of the proposed method and measured values of the concentration of mono-nitrogen oxides and smoke in the exhaust gas of the engine depicted in FIG. 13.
Figure 15:
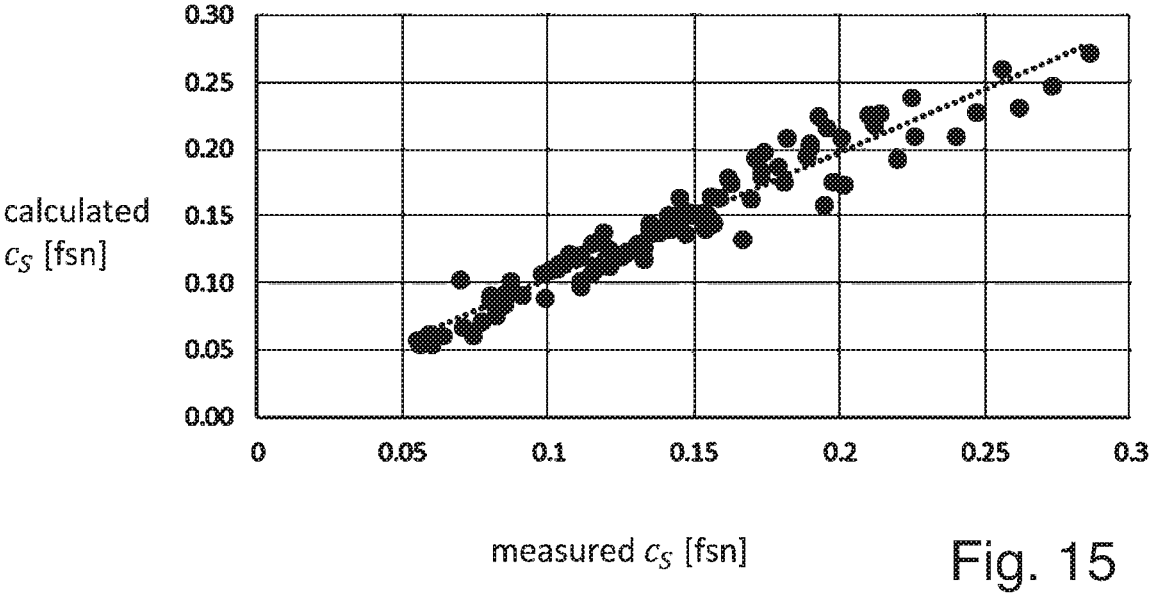

For validation purposes of the proposed method, in FIGS. 14 and 15, values calculated by the ECU of the engine 10 depicted in FIG. 13 by applying the above described method based on the functions $F_{cr_NOx}$, $F_{cr_S}$ $F_{k_NOx}$ and $F_{k_S}$ constructed for the reference condition or reference configuration of the engine 10 as depicted in FIG. 1 are compared to measured values of the effective concentrations of $NO_N$ and smoke during operation of the engine 10.

Specifically, FIG. 14 depicts a diagram illustrating a comparison between calculated and measured values of the effective concentration of $NO_N$ for different operating conditions of the engine 10. The abscissa of the diagram depicts measured values and the ordinate depicts calculated values of the effective concentration $c_{e_NOx}$ of $NO_x$.

FIG. 15 depicts a diagram illustrating a comparison between calculated and measured values of the effective concentration of smoke for different operating conditions of the engine 10. The abscissa of the diagram depicts measured values and the ordinate depicts calculated values of the effective concentration $c_{e_S}$ of smoke in the exhaust gas.

It will be obvious for a person skilled in the art that these embodiments and items only depict examples of a plurality of possibilities. Hence, the embodiments shown here should not be understood to form a limitation of these features and configurations. Any possible combination and configuration of the described features can be chosen according to the scope of the invention.

A method may be provided for determining an amount of a substance in exhaust gas of an internal combustion engine. The method may comprise the steps of determining, for an effective condition of the engine, at least one operating parameter; determining, for a reference condition of the engine, a reference amount of the substance present in exhaust gas of the engine in the reference condition when being operated based on the determined operating parameter; determining an intake manifold temperature difference between the effective condition and the reference condition of the engine; and determining an effective amount of the substance in the exhaust gas of the engine in the effective condition in dependence on the determined reference amount and the determined intake manifold temperature difference.

The proposed method enables to use an engine mapping and/or an engine model performed or constructed for the reference condition of the engine to calculate an amount of the substance in the exhaust gas of the engine when being operated in a condition different from the reference condition. As a result, the provided method may be applied among different conditions of the engine for calculating the amount of the substance in the exhaust gas, without requiring that, for each differing condition, a new engine mapping and a new engine model needs to be performed or constructed.

The proposed method may be used in or for internal combustion engines, such as diesel engines, for determining the amount of substances, such as mono-nitrogen oxides or smoke, in the exhaust gas produced by the engine.

Specifically, the method may be applied to calculate an amount of mono-nitrogen oxides in the exhaust gas of the engine, i.e. when being operated in the effective operating mode. Alternatively or additionally, the method may be applied to calculate an amount of smoke in the exhaust gas of the engine, i.e. when being operated in the effective operating mode. In other words, the substance present in the exhaust gas of the engine is at least one of mono-nitrogen oxides and smoke.

Further, the amount of the substance calculated in the method may refer to a concentration of the substance present in the exhaust gas of the engine. Accordingly, in the step of determining the reference amount of the substance, a concentration of the substance in the exhaust gas of the engine in the reference condition may be determined. Alternatively or additionally, in the step of determining the effective amount of the substance, a concentration of the substance in the exhaust gas of the engine in the effective condition may be determined.

In the proposed method, the effective condition and the reference condition may refer to different operating conditions of the engine. In particular, the effective condition and the reference condition may refer to different operating conditions of a configuration, i.e. of a same configuration, of the engine. Alternatively or additionally, the effective condition and the reference condition of the engine may refer to different configurations of the engine.

As set forth above, the method may comprise the step of determining at least one operating parameter of the engine in the effective condition. Specifically, the operating parameter may include a ratio, in particular a mass ratio, of intake air relative to fuel to be guided into a combustion chamber of the engine.

In the step of determining the reference amount of the substance, reference amount may be determined, in particular based on at least one an engine model and reference performance data of the engine in the reference condition, as a function of at least one of: the air fuel ratio, an engine speed, an engine torque, a fuel injection quantity, a cylinder pressure and a temperature value indicative of a combustion temperature, in particular an intake manifold temperature.

In the following, the step of determining the effective amount of the substance in the exhaust gas of the engine is further specified.

The effective amount of the substance, as set forth above, may be calculated in dependence on the reference amount of the substance and the determined intake manifold temperature difference. Further, for calculating the effective amount of the substance, at least one of the determined operating parameter and a similarity coefficient may be taken into consideration. In other words, the effective amount of the substance may be further calculated in dependence on the determined operating parameter, in particular the ratio of intake air relative to fuel, and/or the similarity coefficient.

Specifically, the effective amount of the substance may be calculated in dependence of a product of the similarity coefficient and the determined intake manifold temperature difference.

More specifically, the effective amount of the substance may be calculated or determined based on the following formula:

$$C_e = \frac{c_r}{1 + k \times \Delta T_{IM}}, \tag{9}$$

wherein $c_e$ indicates the amount of the substance in exhaust gas of the engine in the effective condition; $c_r$ indicates the reference amount of the substance in exhaust gas of the engine in the reference condition; k refers to the similarity coefficient; and $\Delta T_{IM}$ indicates the intake manifold temperature difference.

It has been found that the similarity coefficient depends on the determined reference amount of the substance, i.e. of a reference amount of mono-nitrogen oxides present in the exhaust air of the engine in the reference condition, and the determined operating parameter. Accordingly, the method further comprises a step of determining the similarity coefficient as a function of the determined reference amount of the substance, i.e. of a reference amount of mono-nitrogen oxides present in the exhaust air of the engine in the reference condition, and the determined operating parameter.

Accordingly, the method may further comprise a step of providing a function or a model for determining the similarity coefficient as a function of the determined reference amount of the substance or another substance, i.e. mono-nitrogen oxides, present in the exhaust gas of the engine in the reference condition and the determined operating parameter.

Specifically, the step of providing the function or model for determining the similarity coefficient may comprise the sub steps of:

- running the engine, particularly in the reference condition, at different operating points in view of at least one of an engine speed and engine torque, i.e. at different engine speed and/or engine torque points;
- at each operating point, running the engine at different intake manifold temperatures;
- for each one of the different intake manifold temperature conditions of the engine, determining a data set comprising an amount of the substance, an air fuel ratio and the intake manifold temperature;
- for each one of the different operating points, performing line fitting to determine a slope of a line that fits to first determined data set points comprising the amount of the substance and the associated intake manifold temperature; and/or
- performing curve fitting to determine the function or model, in particular as a polynomial function, that fits to second determined data set points comprising the values of the slope and an associated ratio of the determined amount of the substance and the air fuel ratio.

Furthermore, a system may be provided for use in an internal combustion engine for determining an amount of a substance in exhaust gas of the engine. The system may particularly be provided for performing or executing the above described method. Accordingly, technical features which are described in connection with the above method may also relate and be applied to the proposed system, and vice versa.

The system may form a part of the internal combustion engine, such as a diesel engine, or may be provided separately from the internal combustion engine. The system may comprise a control unit. The control unit may be comprised in or constituted by a control unit of the internal combustion engine.

The control unit of the system may be configured to determine:

- at least one operating parameter of the engine in an effective condition;
- for a reference condition of the engine, a reference amount of the substance present in exhaust gas of the engine in the reference condition when being operated based on the determined operating parameter;
- an intake manifold temperature difference between the effective condition and the reference condition of the engine; and
- an effective amount of the substance in the exhaust gas of the engine in the effective condition in dependence on the determined reference amount and the determined intake manifold temperature difference.

Furthermore, an internal combustion engine for use in a vehicle may be provided, comprising the above described system for determining an amount of a substance in exhaust gas of the engine. Accordingly, technical features which are described in connection with the above system may also relate and be applied to the proposed internal combustion engine, and vice versa.

INDUSTRIAL APPLICABILITY

With reference to the Figures, a method and a system 70 for use in an internal combustion engine 10, i.e. diesel engines, is suggested. The method and the system 70 as mentioned above are applicable in and in connection with internal combustion engines of vehicles.

What is claimed is:

1. A method for determining an amount of a substance in exhaust gas of an internal combustion engine, the method comprises the steps of:

- for an effective condition of the engine, determining at least one operating parameter;
- for a reference condition of the engine, determining a reference amount of the substance present in exhaust gas of the engine in the reference condition when being operated based on the determined operating parameter;
- determining an intake manifold temperature difference between the effective condition and the reference condition of the engine; and
- determining an effective amount of the substance in the exhaust gas of the engine in the effective condition in dependence on the determined reference amount of the substance and the determined intake manifold temperature difference.

2. The method according to claim 1, wherein the substance present in the exhaust gas of the engine is at least one of: mono-nitrogen oxides and smoke.

3. The method according to claim 1, wherein in the step of determining the reference amount of the substance, a concentration of the substance in the exhaust gas of the engine in the reference condition is determined, and wherein in the step of determining the effective amount of the substance, a concentration of the substance in the exhaust gas of the engine in the effective condition is determined.

4. The method according to claim 1, wherein the effective condition and the reference condition refer to different operating conditions of a configuration of the engine.

5. The method according to claim 1, wherein the effective condition and the reference condition refer to different configurations of the engine.

6. The method according to claim 1, wherein the at least one operating parameter comprises a ratio, in particular a mass ratio, of intake air relative to fuel to be guided into a combustion chamber of the engine.

7. The method according to claim 1, wherein the effective amount of the substance in the exhaust gas of the engine in the effective condition is further determined in dependence on the operating parameter.

8. The method according to claim 1, wherein the effective amount of the substance in the exhaust gas of the engine in the effective condition is further determined in dependence on a similarity coefficient, which in particular depends on the reference amount of the substance and the operating parameter.

9. The method according to claim 8, wherein in the step of determining the effective amount of the substance, the effective amount of the substance is determined based on the following formula:

$$c_e = \frac{c_r}{1 + k \times \Delta T_{IM}}$$

wherein $c_r$ indicates the effective amount of the substance in exhaust gas of the engine (10) in the effective condition; $c_r$ indicates the reference amount of the substance in exhaust gas of the engine (10) in the reference condition; k refers to the similarity coefficient; and $\Delta T_{IM}$ indicates the intake manifold temperature difference.

10. The method according to claim 8, further comprising a step of determining the similarity coefficient as a function of the determined reference amount of the substance or another substance, in particular mono-nitrogen oxides, present in the exhaust gas of the engine in the reference condition and the determined operating parameter.

11. The method according to claim 8, further comprising a step of providing a function or model for determining the similarity coefficient as a function of the determined reference amount of the substance or another substance present in the exhaust gas of the engine in the reference condition and the determined operating parameter.

12. The method according to claim 11, wherein the step of providing the function or model for determining the similarity coefficient comprises the sub steps of:

running the engine at different operating points differing from one another in view of at least one of an engine speed and an engine torque;

at each different operating point, running the engine at different intake manifold temperatures;

for each one of the different intake manifold temperature conditions of the engine, determining a data set comprising an amount of the substance in the exhaust gas, an air fuel ratio and the intake manifold temperature;

for each one of the different operating points, performing line fitting to determine a slope of a line that fits to first determined data set points comprising the amount of the substance and the associated intake manifold temperature; and performing curve fitting to determine the function or model, in particular as a polynomial function, that fits to second determined data set points comprising the values of the slope and an associated ratio of the determined amount of the substance and the air fuel ratio.

13. The method according to claim 1, wherein in the step of determining the reference amount of the substance, the reference amount is determined, in particular based on at least one of an engine model and reference performance data of the engine in the reference condition, as a function of at least one of: the air fuel ratio, an engine speed, an engine torque, a fuel injection quantity, a cylinder pressure and a temperature value indicative of a combustion temperature.

14. A system for use in an internal combustion engine for determining an amount of a substance in exhaust gas of the engine, comprising a control unit (ECU) configured to determine:

at least one operating parameter of the engine in an effective condition;

for a reference condition of the engine, a reference amount of the substance present in exhaust gas of the engine in the reference condition when being, operated based on the determined operating parameter;

an intake manifold temperature difference between the effective condition and the reference condition of the engine; and an effective amount of the substance in the exhaust gas of the engine in the effective condition in dependence on the determined reference amount and the determined intake manifold temperature difference.

15. A internal combustion engine for use in a vehicle, comprising a system according to claim 14.

* * * * *